United States Patent [19]

Kokkonen et al.

[11] Patent Number: 4,608,174

[45] Date of Patent: Aug. 26, 1986

[54] FEED AND ACCEPT DUCT SYSTEM FOR HYDROCYCLONES

[75] Inventors: Seppo Kokkonen; Antti Kuhasalo, both of Savonlinna; Erkki Savolainen, Haapakallio; Juha Titoff, Savonlinna; Jorma Vento, Savonlinna; Pentti Vikiö , Savonlinna, all of Finland

[73] Assignee: Enso-Gutzeit Oy, Helsinki, Finland

[21] Appl. No.: 714,096

[22] Filed: Mar. 20, 1985

[30] Foreign Application Priority Data

Mar. 20, 1984 [FI] Finland ..... 841123

[51] Int. Cl.[4] ..... B04C 3/04

[52] U.S. Cl. ..... 210/512.2; 209/211; 209/144; 55/346

[58] Field of Search ..... 162/55; 209/211, 144; 55/346, 345; 210/512.1, 512.2, 787; 406/173

[56] References Cited

U.S. PATENT DOCUMENTS 4,462,899 7/1984 Wambsgans ..... 209/211

*Primary Examiner*—Richard V. Fisher
*Assistant Examiner*—Wanda L. Millard
*Attorney, Agent, or Firm*—Toren, McGeady, Stanger, Goldberg & Kiel

[57] ABSTRACT

The present invention concerns a feed and accept duct system (4) for hydrocyclones (1), comprising common feed and accept ducts (7,8) which have by connecting tubes been connected to the parallel hydrocyclones. This type of construction is used, for instance, in purifying fiber suspensions, in which process the suspension is fed into the hydrocyclones (1) and the purified suspension is removed therefrom as a so-called accept fraction into the accept duct (8). It is essential in the invention that the connecting tubes of the feed and accept ducts (7,8) have been so placed on the different hydrocyclones (1) that the tubes are located substantially in parallel, that the feed and accept ducts have been formed inside a common shell (5) by dividing the space confined by it into two parallel ducts by means of a zigzag partition (6), and that the ends of the connecting tubes (11,12) are located at the folds formed by the bights of the partition, the partition confining the feed duct connecting tubes to be on the feed duct side and the accept duct connecting tubes to be on the accept duct side.

5 Claims, 4 Drawing Figures

FEED AND ACCEPT DUCT SYSTEM FOR HYDROCYCLONES

Figure 1:
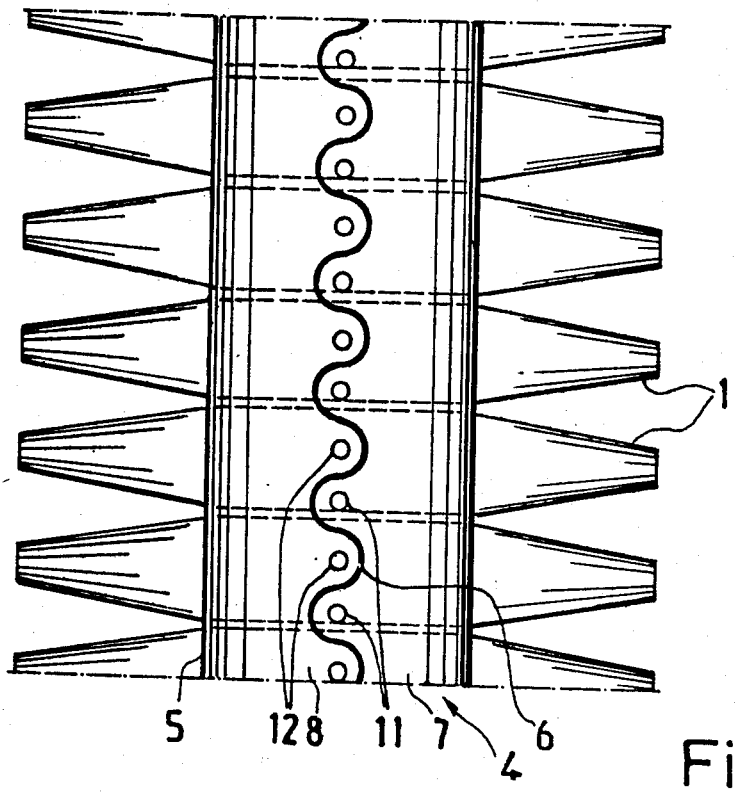

The present invention concerns a feed and accept duct system for hydrocyclones, comprising a common infeed duct which has by connecting tubes been connected to parallel hydrocyclones, and a common accept duct to which said cyclones have similarly been connected with connecting tubes.

The hydrocyclone is a means performing the task of dividing a liquid suspension containing solid matter into two fractions different in composition. Hydrocyclones are used particularly in the pulp and paper industry to separate various dirt particles, such as sand, bark particles, sticks, branch pieces or metal chips from fiber suspensions. The purified fiber suspension emerging from the hydrocyclone and which is transferred to further treatment is then called the accept fraction and, similarly, the fraction containing the dirt particles and which is discarded is called the reject fraction.

A hydrocyclone typically comprises a cylindrical separation chamber, provided with at least one infeed connector for supplying liquid suspension into the cyclone, and with a discharge connector for withdrawing the accept fraction from the cyclone, and a cone in extension of the cylinder, having at its apex an exit aperture for removing the reject fraction. The suspension to be processed is fed into the cyclone tangentially, whereby it is set in a rapid helical rotary movement in the cylindrical separation chamber and the fractions with different specific gravity are separated by action of centrifugal force. When a fiber suspension is being processed in the cyclone, the impurities with higher specific gravity proceed as a helical flow from the separation chamber to the conical part of the cyclone and emerge therefrom as reject fraction, while the fibers with lower specific gravity separate from said helical flow to the center of the cyclone and there form a helical flow having opposite direction. The purified fiber suspension can therefore be removed as accept fraction from the center of the cyclone's separation chamber.

The hydrocyclone is usually applied so that a great number of cyclones have a common feed duct system, from where the suspension to be processed is fed to the cyclones, and a common accept duct system, in which the accept fractions obtained from the cyclones are collected. According to a design of prior art, the cyclones have been connected to the common feed duct with connecting tubes joining tangentially the separating chambers of the cyclones and to the common accept duct, with connecting tubes parallelling the axes of the cyclones and starting in the center of the separating chambers. It is thus understood that in this case the connecting tubes of the feed and accept ducts are crossing at an angle of 90 degrees. The design has however the drawback that the cyclones, and the feed and accept ducts, have to be moved in connection with installation in several directions with reference to each other, causing inconvenience, and it is particularly necessary to fit the connecting tubes so loosely that sealing problems are unavoidable. Another design for connecting the cyclones to the common feed and accept ducts is that in which the cyclones are placed in part inside said ducts. No connecting tubes whatsoever are then needed between the cyclones and the ducts: it is enough to provide feed and accept apertures in the sides of the cyclones, through which the cyclones communicate with the ducts. A drawback of this design is that it requires rather wide feed and accept ducts; moreover, installing the cyclones is awkward work in this case as well.

The object of the present invention is to provide a common feed and accept duct system for hydrocyclones by which the drawbacks of the designs of prior art mentioned above can be avoided. The invention is characterized in that the connecting tubes of the feed and accept ducts are so placed in the different hydrocyclones that the tubes are located substantially in parallel, that the feed and accept ducts have been established within a common shell by dividing the space defined by this shell into two parallel ducts by means of a zigzag partition, and that the ends of the connecting tubes are located at the folds formed by the bights of the partition, the partition thus confining the feed duct connecting tubes to be on the side of the feed duct and the accept duct connecting tubes to be on the side of the accept duct.

In the design of the invention, the feed and accept ducts are connectable to parallel hydrocyclones with a single, simple movement, which makes the mounting extremely simple and easy. Since the connecting tubes between the cyclones and the ducts are not required to be particularly loose-fitting, no sealing problems will be encountered either with this design. A particular advantage of the design of the invention is its compactness, making its space requirements remarkably less than those of the constructions of the prior art, where the feed and accept ducts are completely separated. The use of space may be rendered even more efficient by placing cyclones in two rows on either side of the feed and accept duct system and placing the cyclones in these rows as close to each other as possible.

Figure 2:
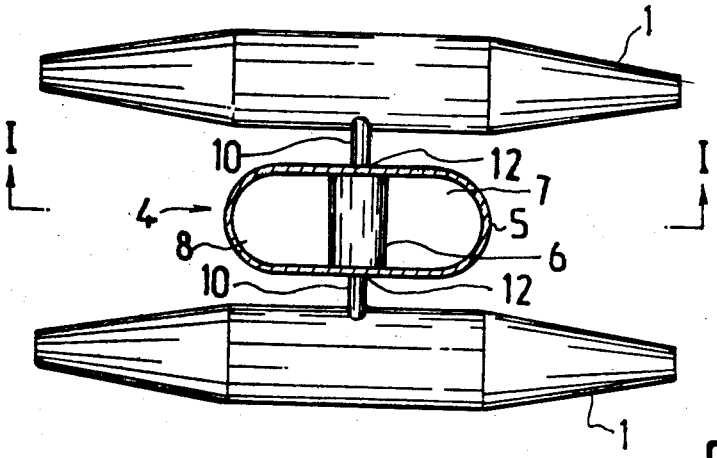
Figure 3:
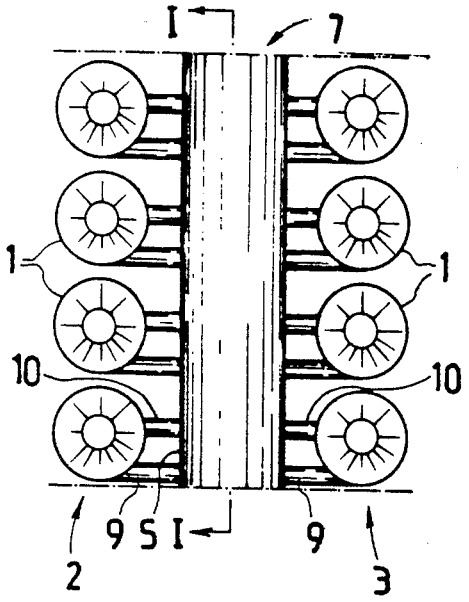
Figure 4:
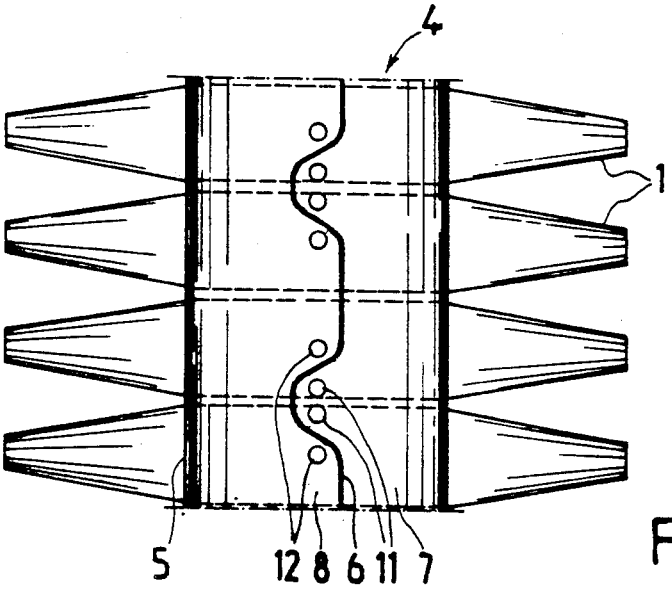

The invention is described in the following more in detail with the aid of examples, referring to the drawings attached, wherein:

FIG. 1 presents parallel hydrocyclones connected to a feed and accept duct system according to the invention, in sectional view, FIG. 2 is a section of the construction of FIG. 1, perpendicular against the direction of the duct system, FIG. 3 shows the construction of FIG. 1 as viewed in the direction of the hydrocyclones' axes, and FIG. 4 corresponds to FIG. 1 and presents another embodiment of the invention.

In FIGS. 1–3 is presented a construction which comprises hydrocyclones 1 arranged in two parallel rows 2,3 and a common feed and accept duct system 4 located between the hydrocyclone rows. The hydrocyclones 1 are appropriate e.g. for purifying fiber suspensions from sand, pieces of bark or equivalent impurities in connection with papermaking.

The feed and accept duct system 4 has been formed by dividing the space confined by the common cylindrical shell 5 into two parts by means of an undulating partition 6 zigzagging in the longitudinal direction of said space. One of the two parts constitutes the common feed duct 7 of the hydrocyclones 1 and the other, the common accept duct 8. The feed and accept ducts 7,8 have been connected to the cyclones 1 with connecting tubes 9,10, which are mutually parallel and located in rows on different sides of the feed and accept duct system 4 so that in each row the tubes are substantially uniformly spaced. The ends 11,12 of the connecting tubes are located in the shell 5 at the folds produced by the partition 6, so that the partition confines the ends 11 of the connecting tubes 9 of the feed duct 7 to be on the feed duct side and the ends 12 of the connecting tubes 10 of the accept duct 8, on the accept duct side. The folds making up the partition 6 run across the space confined by the shell 5 perpendicular to the direction of the feed and accept ducts 7,8, and the connecting tubes 9 or 10 starting at the opposite ends of each fold lead to cyclones 1 on different sides of the feed and accept duct system 4.

The connecting tubes 9,10 are so connected to the hydrocyclones 1 that the connecting tubes 9 of the feed duct 7 join the cyclones tangentially, whereas the connecting tubes 10 of the accept duct 8 are connected substantially to the center of the cyclones. The suspension fed to the cyclones 1 through the connecting tubes 9 is thus set in rapid helical rotary movement, the centrifugal force thereby generated causing the impurities in the suspension to move towards the conical apical parts of the cyclones, from where the impurities escape as reject fraction, while the purified suspension moves to the center of the cyclones and discharges as accept fraction through the connecting tubes 10 into the accept duct 8.

In the embodiment of FIGS. 1-3, the connecting tubes 9,10 are so placed in rows that every second tube connects with the feed duct 7 and every second tube with the accept duct 8, and the partition 6 zigzags between the tube ends 11,12 and forms a fold at each tube end. In FIG. 4 is in contrast presented an embodiment in which the connecting tubes 9,10 have been arranged in pairs in a row so that the tubes of every second pair are connected to the feed duct 7 and the tubes of every second pair to the accept duct, and in which the partition 6 winds between the tube ends 11,12 and forms a fold at the ends of each tube pair. In other respects, the embodiment of FIG. 4 is equivalent to that which has been described in the foregoing in association with FIGS. 1-3.

It is obvious to a person skilled in the art that various embodiments of the invention are not confined to the examples presented in the foregoing and that they may vary within the scope of the claims following below.

We claim:

1. A feed and accept duct system for hydrocyclones, comprising a common feed duct, connected through connecting tubes to parallel hydrocyclones, and a common accept duct, to which said cyclones are similarly connected through connecting tubes, the connecting tubes of the feed and accept ducts leading to the different hydrocyclones being places so that the tubes are located substantially in parallel, and the feed and accept ducts being formed inside a common shell by dividing the space which it confines into two parallel ducts with a zigzag partition, and the ends of the connecting tubes being located at the folds produced by the bights of the partition, the partition thereby confining the feed duct connecting tubes to the feed duct side and the accept duct connecting tubes to the accept duct side.

2. Feed and accept duct system according to caim 1, wherein the connecting tubes of the different hydrocyclones are located in rows in which every second tube connects with the feed duct and every second tube with the accept duct and the partition zigzags between the tube ends, forming a fold at each tube end.

3. Feed and accept duct system according to claim 1, wherein the connecting tubes of the hydrocyclones are located in rows in pairs so that the tubes of every second pair connect with the feed duct and the tubes of every second pair with the accept duct, and the partition zigzags between the tube ends, forming a fold at the ends of each tube pair.

4. Feed and accept duct system according to claim 1, wherein the duct system is located between two parallel hydrocyclone rows and the feed and accept ducts are connected to the hydrocyclones of each row by means of connecting tubes starting on the opposite sides of the ducts.

5. Feed and accept duct system according to claim 4, wherein the ends of th connecting tubes are located in pairs on opposite sides of the feed and accept ducts at opposite ends of the folds, running transversely to the ducts, formed by the partition.

* * * * *